US008911283B2

(12) United States Patent
Besse et al.

(10) Patent No.: US 8,911,283 B2
(45) Date of Patent: Dec. 16, 2014

(54) ABRASIVE TOOL AND A METHOD FOR FINISHING COMPLEX SHAPES IN WORKPIECES

(75) Inventors: John R. Besse, Beacon Falls, CT (US); David C. Graham, Oakham, MA (US); Krishnamoorthy Subramanian, Lexington, MA (US); Srinivasan Ramanath, Holden, MA (US); Marc A. Lamoureux, Leicester, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 213 days.

(21) Appl. No.: 13/198,916

(22) Filed: Aug. 5, 2011

(65) Prior Publication Data

US 2012/0034847 A1 Feb. 9, 2012

Related U.S. Application Data

(60) Provisional application No. 61/371,581, filed on Aug. 6, 2010.

(51) Int. Cl.
*B24B 1/00* (2006.01)

(52) U.S. Cl.
USPC ..... 451/547; 451/541; 451/913

(58) Field of Classification Search
USPC ..... 451/9, 10, 11, 28, 53, 54, 57, 58, 69, 451/70, 547, 541, 913
See application file for complete search history.

(56) References Cited

U.S. PATENT DOCUMENTS

| | | | | |
|---|---|---|---|---|
| 3,771,509 | A | 11/1973 | Murchie | |
| 3,778,936 | A | 12/1973 | Steadman | |
| 4,110,939 | A | 9/1978 | Bodolai | |
| 4,237,659 | A | 12/1980 | Welsch et al. | |
| 4,260,331 | A * | 4/1981 | Goodwin | 416/219 R |
| 4,537,538 | A | 8/1985 | Mitamura et al. | |
| 4,588,420 | A | 5/1986 | Charvat | |

(Continued)

FOREIGN PATENT DOCUMENTS

| | | |
|---|---|---|
| EP | 0153852 A1 | 9/1985 |
| EP | 1721704 A1 | 11/2006 |

(Continued)

OTHER PUBLICATIONS

International Search Report and The Written Opinion, PCT/US2011/046805, mailed Mar. 8, 2012, 13 pages.

(Continued)

*Primary Examiner* — Lee D Wilson
*Assistant Examiner* — Joel Crandall
(74) *Attorney, Agent, or Firm* — Abel Law Group, LLP; Joseph P. Sullivan

(57) ABSTRACT

An abrasive tool includes a bonded abrasive body having abrasive grains contained within a bonding material, wherein the bonded abrasive body comprises a complex shape having a form depth (FD) of at least about 0.3. The form depth is described by the equation [(Rl−Rs)/Rl], wherein Rs is a smallest radius (Rs) at a point along the longitudinal axis of the bonded abrasive body and Rl is a largest radius (Rl) at a point along the longitudinal axis of the bonded abrasive body. The abrasive tool can be used to finish complex shapes in workpieces.

20 Claims, 6 Drawing Sheets

(56) References Cited

U.S. PATENT DOCUMENTS

| | | | | |
|---|---|---|---|---|
| 4,692,976 | A * | 9/1987 | Andrews | 29/889.7 |
| 4,824,328 | A * | 4/1989 | Pisz et al. | 416/219 R |
| 5,152,669 | A | 10/1992 | Heinig et al. | |
| 5,160,242 | A * | 11/1992 | Brown | 416/193 A |
| 5,176,500 | A * | 1/1993 | Heinig | 416/219 R |
| 5,306,318 | A | 4/1994 | Carius et al. | |
| 5,330,326 | A | 7/1994 | Kuehne et al. | |
| 5,430,936 | A | 7/1995 | Yazdzik, Jr. et al. | |
| 5,782,679 | A | 7/1998 | Hunter | |
| 6,007,281 | A * | 12/1999 | Eriksson et al. | 409/132 |
| 6,082,935 | A * | 7/2000 | Hori | 407/54 |
| 6,142,737 | A * | 11/2000 | Seeley et al. | 416/222 |
| 6,164,877 | A * | 12/2000 | Kamata et al. | 407/61 |
| 6,321,502 | B1 * | 11/2001 | Castano | 52/653.2 |
| 6,322,296 | B1 * | 11/2001 | Wetli et al. | 407/42 |
| 6,475,253 | B2 | 11/2002 | Culler et al. | |
| 6,592,330 | B2 * | 7/2003 | Leeke et al. | 416/219 R |
| 6,652,237 | B2 * | 11/2003 | Yehle et al. | 416/219 R |
| 6,669,747 | B2 | 12/2003 | Salmon | |
| 6,883,234 | B2 * | 4/2005 | Packman et al. | 29/889.2 |
| 6,979,713 | B2 | 12/2005 | Barber, Jr. | |
| 7,007,382 | B2 * | 3/2006 | Mantel | 29/889.2 |
| 7,175,786 | B2 | 2/2007 | Celikkaya et al. | |
| 7,258,707 | B2 | 8/2007 | Celikkaya et al. | |
| 7,275,980 | B2 | 10/2007 | Bonner et al. | |
| 7,332,453 | B2 | 2/2008 | Rosenflanz et al. | |
| 7,504,149 | B2 * | 3/2009 | Toihara et al. | 428/216 |
| 7,563,294 | B2 | 7/2009 | Rosenflanz | |
| 7,618,219 | B2 * | 11/2009 | Osawa et al. | 407/53 |
| 7,708,619 | B2 * | 5/2010 | Subramanian et al. | 451/11 |
| 8,038,404 | B2 * | 10/2011 | Mujezinovic et al. | 416/219 R |
| 2002/0026752 | A1 | 3/2002 | Culler et al. | |
| 2003/0110706 | A1 | 6/2003 | Rosenflanz | |
| 2003/0154658 | A1 | 8/2003 | Salmon | |
| 2004/0064944 | A1 | 4/2004 | Packman et al. | |
| 2004/0087256 | A1 | 5/2004 | Schwartz et al. | |
| 2004/0101680 | A1 | 5/2004 | Barber, Jr. | |
| 2004/0148870 | A1 | 8/2004 | Celikkaya et al. | |
| 2004/0148966 | A1 | 8/2004 | Celikkaya et al. | |
| 2005/0132657 | A1 | 6/2005 | Celikkaya et al. | |
| 2006/0021285 | A1 | 2/2006 | Rosenflanz et al. | |
| 2006/0040584 | A1 | 2/2006 | Ray et al. | |
| 2006/0111032 | A1 | 5/2006 | Weston et al. | |
| 2007/0020457 | A1 | 1/2007 | Adefris | |
| 2007/0074456 | A1 | 4/2007 | Orlhac et al. | |
| 2007/0099548 | A1 | 5/2007 | Kumar et al. | |
| 2007/0275641 | A1 | 11/2007 | Subramanian et al. | |
| 2008/0032601 | A1 | 2/2008 | Arcona et al. | |
| 2008/0236051 | A1 | 10/2008 | Schwabel et al. | |
| 2009/0022591 | A1 | 1/2009 | Mujezinovic et al. | |
| 2009/0094831 | A1 | 4/2009 | Schwartz et al. | |
| 2011/0179646 | A1 * | 7/2011 | Barnat | 29/889.21 |

FOREIGN PATENT DOCUMENTS

| | | | |
|---|---|---|---|
| JP | 2080531 | A2 | 3/1990 |
| JP | 4240061 | A2 | 8/1992 |
| JP | 2000-326232 | A | 11/2000 |
| JP | 2001-246565 | A | 9/2001 |
| JP | 2002-263937 | A | 9/2002 |
| JP | 2003-136410 | A | 5/2003 |
| JP | 2004-034246 | A | 2/2004 |
| JP | 2006-272467 | A | 10/2006 |
| JP | 2007-317973 | A | 12/2007 |
| JP | 2009-046091 | A | 3/2009 |
| JP | 2009-083021 | A | 4/2009 |
| JP | 2010-52070 | A | 3/2010 |
| RU | 2319599 | C2 | 3/2008 |
| WO | 99/38817 | A1 | 8/1999 |
| WO | 2005/105377 | A1 | 11/2005 |
| WO | 2009/046091 | A1 | 4/2009 |

OTHER PUBLICATIONS

Cheil Grinding Wheel Ind. Co., Ltd., "Mounted Point Wheels", K-PRIX, 1 page.

Direct Industry, The Online Industrial Exhibition, "Bonded abrasive, grinding wheel", search conducted Aug. 29, 2013, 6 pages.

Grier Abrasive Co. Inc., "Mounted Points for the Investment Cast Industry," Copyright 2002, 3 pages.

IHS Global Spec, "Superabrasives and Diamond Tools Information", 1 page.

Jim Trade.com, India's Largest Online Business Directory, "Mounted Wheels and Points for Superfine Grinding Work," Search conducted Aug. 29, 2013, 2 pages.

Jim Trade.com, India's Largest Online Business Directory, "Rubber Bonded Flexible Mounted Points," Search conducted Aug. 29, 2013, 2 pages.

Rexlee Diamond Tools, "Internal Diamond Grinding Mounted Point and Wheel", Copyright 2008 Rex Lee, 2 pages.

Sterling Abrasives, Ind., Grinding Wheels, "Mounted Points Internal Wheels Plugs and Cones," Copyright 2009 Sterling Abbrasives Ltd, 2 pages.

Super Abrasives, "Super Abrasives: Mounted Wheel and Points", Copyright 2012-2013 by Super Abraisves, 2 pages.

Valgro-Fynex Superlative Surface Solutions, "Bonded Abrasives Mounted Points", Copyright 2008, Valgro-Fynex, 2 pages.

Varun Diamond Tools, "Diamond Mounted Points, CBN Mounted Points & Core Drills," 4 pages.

* cited by examiner

ABRASIVE TOOL AND A METHOD FOR FINISHING COMPLEX SHAPES IN WORKPIECES

BACKGROUND

1. Field of the Disclosure

This non-provisional application claims priority to and the benefit of U.S. Provisional App. No. 61/371,581, filed Aug. 6, 2010, and is incorporated herein by reference in its entirety.

The following is directed to abrasive tools and methods of finishing complex shapes in workpieces using such abrasive tools, and more particularly, use of bonded abrasive tools having particular shapes for finishing of complex shapes within workpieces.

2. Description of the Related Art

Within the industry of finishing, various processes may be employed to finish workpieces. However, in the particular context of finishing workpieces to have complex shapes, few options are available since such finishing operations require exacting surface contours and tight dimensional tolerances. Certain preferred approaches are milling or broaching, where blades are used to cut the complex shape in the workpiece. However, broaching can be an expensive operation, due to high tooling costs, expensive machinery, set-up costs, tooling regrinding costs and slow material removal rates. Milling processes are generally very slow, especially in machining difficult-to-machine materials, such as nickel alloys.

Still, in the context of forming retention slots in turbine disks, which are used to hold or retain turbine blades around the periphery of the disk, broaching is the preferred approach throughout most of the industry. Current practice in the aerospace industry is to machine slots into the disk by use of a broaching machine, which is a linear cutting machine that drives successively larger cutters through the disk slot, with the final cutters having a desired complex shape (i.e., a re-entrant shape) of the finished slot. Broaching is illustrated in U.S. Pat. No. 5,430,936 to Yadzik, Jr. et al.

Another method for producing profiled parts is illustrated in U.S. Pat. No. 5,330,326 to Kuehne et al. The method involves pre-shaping and finish grinding a blank in one chucking position with at least one profiled grinding wheel. The blank is translated and rotated relative to the at least one profiled grinding wheel during the pre-shaping step for giving the blank approximately a desired profile. However, the Kuehne method may be used for external surfaces, and not internal surfaces, and thus is not applicable to the creation of internal slots.

Other methods of producing complex shapes in workpieces are disclosed in U.S. Pat. No. 6,883,234 and U.S. Pat. No. 7,708,619. In U.S. Pat. No. 7,708,619 to Subramanian et al., the processes utilizes grinding with a large diameter wheel operated perpendicular to the surface of the part for initial formation of a slot within the workpiece. Finishing of the slot to the desired contour is completed using a single-layered electroplated tool.

There is a need to develop new methods to form complex shapes within workpieces and limit the shortcomings associated with conventional processes.

SUMMARY

According to a first aspect, an abrasive tool includes a bonded abrasive body having abrasive grains contained within a bonding material, wherein the bonded abrasive body comprises a complex shape having a form depth (FD) of at least about 0.3, wherein the form depth is described by the equation [(Rl−Rs)/Rl]. Notably, Rs is a smallest radius (Rs) at a point along the longitudinal axis of the bonded abrasive body and Rl is a largest radius (Rl) at a point along the longitudinal axis of the bonded abrasive body.

According to another aspect, a method of finishing a workpiece includes rotating a bonded abrasive tool relative to a workpiece for finishing a re-entrant shape opening in the workpiece. The bonded abrasive tool includes a bonded abrasive body having abrasive grains contained within a bonding material, and wherein finishing comprises forming a surface defining the re-entrant shape opening having a surface roughness ($R_a$) of not greater than about 2 microns.

In yet another aspect, a method of operating an abrasive tool includes finishing a re-entrant shape opening in a workpiece using a mounted point abrasive tool comprising abrasive grains contained within a bonding material. The body has a complex shape having a form depth (FD) of at least about 0.3, wherein the form depth is described by the equation [(Rl−Rs)/Rl], and Rs is a smallest radius (Rs) at a point along the longitudinal axis of the body and Rl is a largest radius (Rl) at a point along the longitudinal axis of the body. Notably, Rs is not greater than about 10 mm. The method further includes plunge dressing the mounted point abrasive tool along a form length of the body.

Another aspect includes a method of finishing a workpiece including providing a workpiece having a re-entrant shaped opening roughly formed in a surface of the workpiece, and finishing the re-entrant shaped opening using a mounted point abrasive tool comprising abrasive grains contained within a vitreous bond. During finishing, a water-soluble coolant material is provided at an interface of the mounted point abrasive tool and a surface of the workpiece defining the re-entrant shaped opening.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

The following is directed to abrasive tools, and more particularly bonded abrasive tools suitable for finishing of surfaces having complex shapes within workpieces. It will be appreciated that bonded abrasives are a separate and distinct class from other abrasives (e.g. coated abrasives, etc.) in that bonded abrasives have a three-dimensional shape including a dispersion of abrasive grains throughout out a three-dimensional volume, which are contained within a three-dimensional volume of bonding material. Moreover, bonded abrasive bodes may include some amount of porosity, which may facilitate chip formation and exposure of new abrasive grains. Chip formation, abrasive grain exposure, and dressing are certain attributes associated with bonded abrasives, and which distinguish bonded abrasives from other classes of abrasives, such as coated abrasives or single layer electroplated tools.

As used herein, the term "complex shape" refers to a shape (e.g., of an opening within a workpiece) or a shape of a part (e.g., a bonded abrasive body) that has a contour defining a re-entrant shape. A re-entrant shape does not allow a mating form to be removed in a direction normal to one of three axes (i.e., x, y or z). A "re-entrant shape" can be a contour that is re-entering or pointing inward, which is wider at an inner axial position than at an outer axial position (i.e., an entrance). An example of the re-entrant shape is a dovetail slot, a keystone shape, and the like.

Turbine components, such as jet engine, rotors, compressor blade assembly, typically employ re-entrant shaped slots in the turbine disks. The re-entrant shape can be used to hold or retain turbine blades around the periphery of turbine disks. Mechanical slides, T-slots to clamp parts on a machine table also use such re-entrant shaped slots.

With respect to a process of forming a complex shape in a workpiece, an initial slot formation process can be undertaken, which forms an opening within the workpiece. The opening or slot does not necessarily have the final contour (i.e., complex shape). The slot formation process can remove the bulk of material, minimizing the amount of material to be removed in the complex shape finishing process with a bonded abrasive tool.

Figure 1:
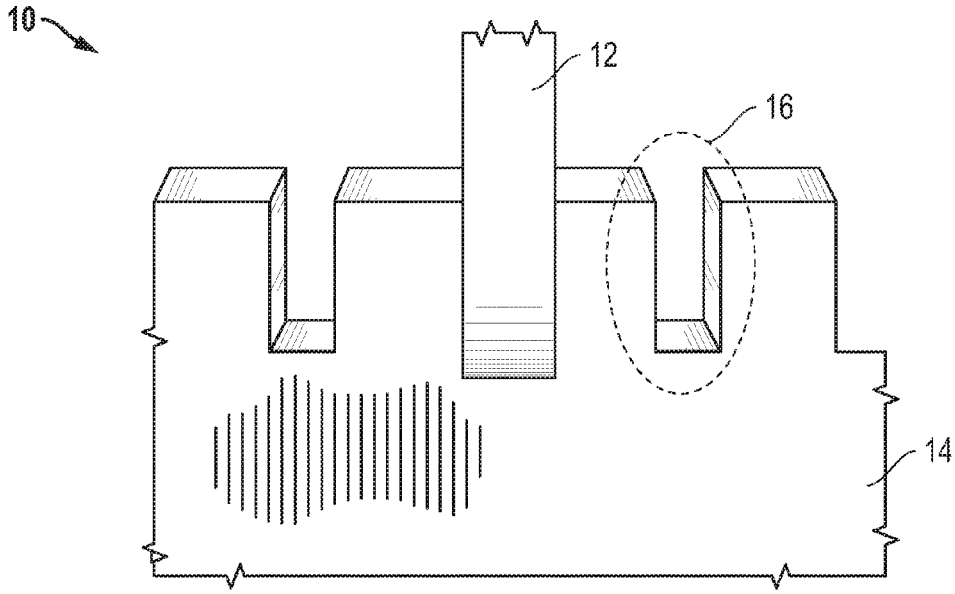
FIG. 1 includes a schematic representation of a slot formation process.

FIG. 1 includes an illustration of a slot formation process 10. As illustrated, the slot formation process can utilize a bonded abrasive tool 12, oriented in a particular manner with respect to the workpiece 14, thereby forming slot(s) 16 in workpiece 14. In a particular embodiment, the slot formation processes of the invention can be completed using a bonded abrasive tool 12 oriented with respect to the workpiece 14 to conduct a creep-feed grinding process. The creep-feed grinding can be conducted at grinding speed in a range between about 30 m/s and about 150 m/s.

Figure 2A:
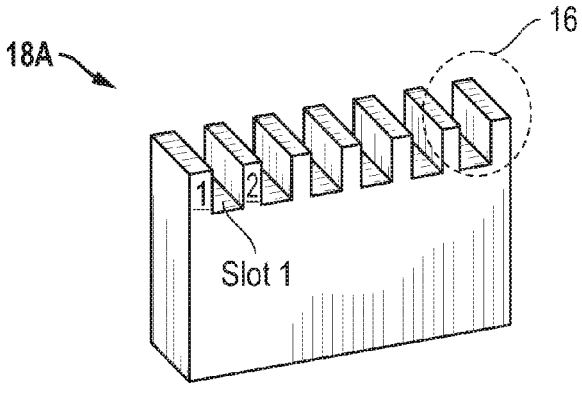
FIGS. 2(*a*) and 2(*b*) include schematic representations of slots that can be generated by the slot formation process.
Figure 2B:
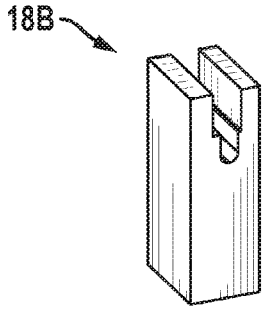

FIGS. 2(*a*) and 2(*b*) include schematic representations of slots that can be generated by the slot formation process. In particular, FIGS. 2(*a*) and 2(*b*) include workpieces 18A and 18B that can be formed by the slot formation processes 10 of the invention, respectively. In one embodiment, slot 16 has a single diameter throughout the depths of the slot 16, as shown in FIG. 2(*a*). In another embodiment, slot 16 has at least two distinct diameters at different depths, as shown in FIG. 2(*b*).

The slot formation process may utilize a particular specific cutting energy. For example, the specific cutting energy may be equal to, or less than, about 10 Hp/in$^3$ min (about 27 J/mm$^3$), such as between about 0.5 Hp/in$^3$ min (about 1.4 J/mm$^3$) and about 10 Hp/in$^3$ min (about 27 J/mm$^3$) or between about 1 Hp/in$^3$ min (about 2.7 J/mm$^3$) and about 10 Hp/in$^3$ min (about 27 J/mm$^3$)

In another embodiment, the slot formation process can be conducted at a particular material removal rate (MRR), such as in a range of between about 0.25 in$^3$/min in (about 2.7 mm$^3$/sec/mm) and about 60 in$^3$/min in (about 650 mm$^3$/sec/mm) at a maximum specific cutting energy of about 10 Hp/in$^3$ min (about 27 J/mm$^3$) Further details of the slot forming process, which may be utilized in conjunction with the finishing process disclosed herein, are presented in U.S. Pat. No. 7,708,619, the teachings of which are incorporated herein by reference.

The slot formation process, and thus the finishing process of the embodiments herein can be completed on certain types of materials, including hard-to-grind materials. The invention workpieces can be metallic, and particularly metal alloys such titanium, Inconel (e.g., IN-718), steel-chrome-nickel alloys (e.g., 100 Cr6), carbon steel (AISI 4340 and AISI 1018) and combinations thereof. In accordance with one embodiment, the workpiece can have hardness value of equal to or less than about 65 Rc, such as between about 4 Rc and about 65 Rc (or 84 to 111 Rb hardness). This is in contrast to prior art machining processes that typically can be used only for softer materials, i.e., those having a maximum hardness value of about 32 Rc. In one embodiment, the metallic workpieces for the invention have a hardness value of between about 32 Rc and about 65 Rc or between about 36 Rc and about 65 Rc.

In the slot formation process, a bonded abrasive tool can be used, such as grinding wheels and cutoff wheels. The bonded abrasive tool for use in the slot formation process can include at least about 3 volume % (on a tool volume basis) of a filamentary sol gel alpha-alumina abrasive grain, optionally including secondary abrasive grains or agglomerates thereof. Suitable methods for making bonded abrasive tools are disclosed in U.S. Pat. Nos. 5,129,919; 5,738,696; 5,738,697; 6,074,278; and 6,679,758 B, and U.S. patent application Ser. No. 11/240,809 filed Sep. 28, 2005, the teachings of which are incorporated herein by reference. Particular details of the bonded abrasive tool used in the slot forming process are provided in U.S. Pat. No. 7,708,619, the teachings of which are incorporated herein by reference.

Referring now to operations following the slot formation process, a finishing process can be conducted to change the contour of the slot to a complex shape (e.g., re-entrant shape). The tools used to conduct the slot formation and the finishing process can be part of high efficiency grinding machines, including multi-axis machining centers. With a multi-axis machining center, both the slot formation and the complex shape finishing process can be carried out on the same machine. Suitable grinding machines include, e.g., a Campbell 950H horizontal axis grinding machine tool, available from Campbell Grinding Company, Spring Lake, Mich., and a Blohm Mont. 408, three axis, CNC creep feed grinding machine, available from Blohm Maschinenbau GmbH, Germany.

Figure 3A:
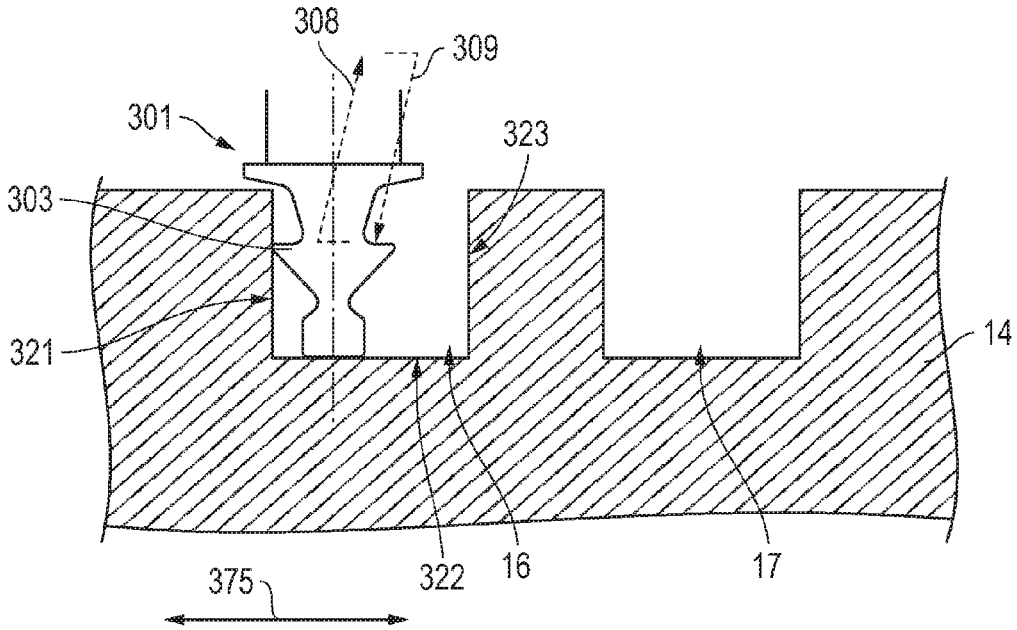
FIG. 3A includes an illustration of a finishing operation using a bonded abrasive tool according to an embodiment.

FIG. 3A includes an illustration of a finishing operation using a bonded abrasive tool according to an embodiment. In particular, FIG. 3A illustrates a finishing operation to form a complex shape within the slot 16 of the workpiece 14 with a bonded abrasive tool 301 in the form of a mounted point tool. The bonded abrasive tool 301 can have a complex shape suitable for producing a corresponding complex shape within the workpiece 14. That is, the bonded abrasive body 303 can have a shape that is the inverse of a complex shape, to be imparted into the workpiece 14.

In accordance with embodiments herein, the bonded abrasive tool 301 can have a bonded abrasive body 303 including abrasive grains contained within a matrix of bonding material. That is, the bonded abrasive tool incorporates abrasive grains dispersed throughout a three-dimensional matrix of bonding material. In accordance with an embodiment, the abrasive grains can include superabrasive materials. For example, suitable superabrasive materials can include cubic boron nitride, diamond, and a combination thereof. In certain instances, the bonded abrasive body 303 can include abrasive grains that consist essentially of diamond. However, in other tools, the bonded abrasive body 303 can include abrasive grains that consist essentially of cubic boron nitride.

The bonded abrasive tool can be formed such that it has an abrasive body incorporating abrasive grains having an average grit size of not greater than about 150 microns. In some embodiments, the abrasive grains can have an average grit size of not greater than about 125 microns, such as not greater than about 100 microns, or even not greater than about 95 microns. In particular instances, the abrasive grains have an average grit size within a range between about 10 microns and 150 microns, such as between about 20 microns and 120 microns, or even between about 20 microns and 100 microns.

With regard to the bonding material within the bonded abrasive body 303, suitable materials can include organic materials, inorganic materials, and a combination thereof. For example, suitable organic materials may include polymers such as resins, epoxies, and the like.

Some suitable inorganic bond materials can include metals, metal alloys, ceramic materials, and a combination thereof. For example, some suitable metals can include transition metal elements and metal alloys containing transition metal elements. In other embodiments, the bond material may be a ceramic material, which can include polycrystalline and/or vitreous materials. Suitable ceramic bonding materials can include oxides, including for example, $SiO_2$, $Al_2O_3$, $B_2O_3$, MgO, CaO, $Li_2O$, $K_2O$, $Na_2O$ and the like.

Further, it will be appreciated that the bonding material can be a hybrid material. For example, the bonding material can include a combination of organic and inorganic components. Some suitable hybrid bond materials can include metal and organic bond materials.

In accordance with at least one embodiment, the bonded abrasive tool 301 can include a composite including bond material, abrasive grains, and some porosity. For example, the bonded abrasive tool 301 can have at least about 3 vol % abrasive grains (e.g., superabrasive grains) of the total volume of the bonded abrasive body. In other instances, the bonded abrasive tool 301 can include at least about 6 vol %, at least about 10 vol %, at least about 15 vol %, at least about 20 vol %, or even at least about 25 vol % abrasive grains. Particular bonded abrasive tools 301 can be formed to include between about 2 vol % and about 60 vol %, such as between about 4 vol % and about 60 vol %, or even between about 6 vol % and about 54 vol % superabrasive grains.

The bonded abrasive tool 301 can be formed to have at least about 3 vol % bond material (e.g., vitrified bond or metal bond material) of the total volume of the bonded abrasive body. In other instances, the bonded abrasive tool 301 can include at least about 6 vol %, at least about 10 vol %, at least about 15 vol %, at least about 20 vol %, or even at least about 25 vol % bond material. Particular bonded abrasive tools 301 can include between about 2 vol % and about 60 vol %, such as between about 4 vol % and about 60 vol %, or even between about 6 vol % and about 54 vol % bond material.

The bonded abrasive tool 301 can be formed to have a certain content of porosity, and particularly an amount of not greater than about 60 vol % of the total volume of the bonded abrasive body. For example, the bonded abrasive body 301 can have not greater than about 55 vol %, such as not greater than about 50 vol %, not greater than about 45 vol %, not greater than about 40 vol %, not greater than about 35 vol %, or even not greater than about 30 vol % porosity. Particular bonded abrasive tools 301 can have a certain content of porosity, such as between about 0.5 vol % and about 60 vol %, such as between about 1 vol % and about 60 vol %, between about 1 vol % and about 54 vol %, between about 2 vol % and about 50 vol %, between about 2 vol % and about 40 vol %, or even between about 2 vol % and about 30 vol % porosity.

Figure 3B:
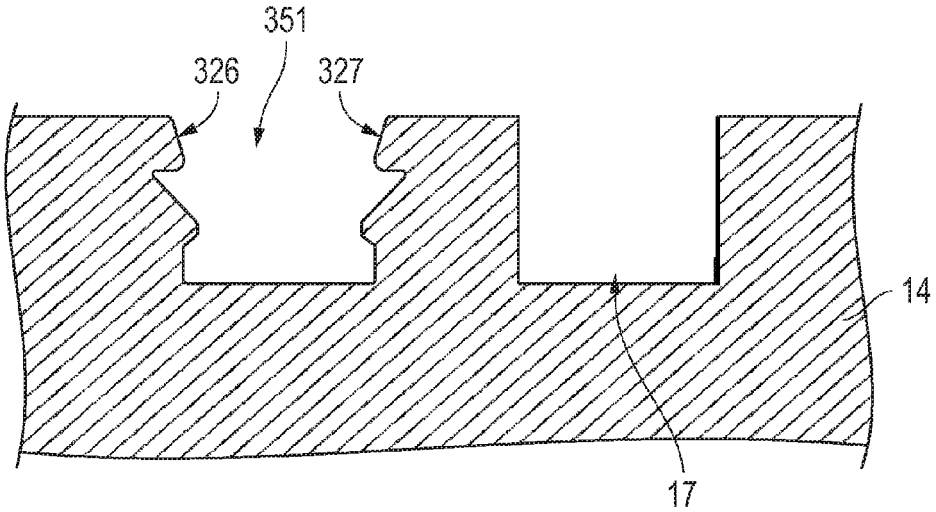
FIG. 3B includes an illustration of a finished opening in a workpiece having a complex shape, wherein the finished opening is formed using a bonded abrasive tool according to an embodiment.

During the finishing process, a bonded abrasive tool 301 can be placed in contact with the workpiece 14, and more particularly within the slot 16 previously formed within the workpiece 14. In accordance with an embodiment, the bonded abrasive tool 301 can be rotated at a significantly high speed to finish and recontour the surfaces 321 and 323 of the slot 16 to form a complex shape within the workpiece 14 (see for example 351 of FIG. 3B). For example, the bonded abrasive tool can be rotated at speeds of at least about 10,000 rpm. In other instances, the tool may be rotated at greater speeds, such as at least about 20,000 rpm, at least about 30,000 rpm, at least about 40,000 rpm, or even greater. Still, in certain instances the bonded abrasive tool 301 is rotated relative to the workpiece 14 at a speed within a range between about 10,000 and 250,000 rpm, such as between about 10,000 rpm and 125,000 rpm, about 10,000 rpm and 110,000 rpm, or even between about 10,000 rpm and about 100,000 rpm.

During finishing, the bonded abrasive tool 301 can be moved along an axis relative to the workpiece 14 to facilitate finishing of the surface 321 to a suitable, complex shape. For example, in certain instances the bonded abrasive tool 301 can follow a reciprocating pathway or complete a box cycle. For example, in a first pass of the reciprocating pathway, the bonded abrasive tool 300 can be moved relative to the workpiece 14 along a path 308. Movement of the bonded abrasive tool 300 along the path 308 facilitates finishing of the full thickness of the surface 321. According to one type of reciprocating pathway, after completing the first pass along path 308, the bonded abrasive tool 301 can be shifted laterally along the axis 375 and moved along a path 309 in a second pass. According to this particular reciprocating pathway, during the second pass, the surface of the bonded abrasive tool 301 can contact surface 323 of the slot 16 opposite the surface 321, thereby finishing the portion of the slot 16 defined by the surface 323. After the bonded abrasive tool 301 travels along the full thickness of the workpiece through the slot 16, the tool can then again be shifted laterally along the axis 375 and returned to the path 308 for another (i.e., third) pass along the surface 321. It will be appreciated that the bonded abrasive tool 301 may be reciprocated and moved along paths 308 and 309 for a designated number of turns until the surfaces 321 and 323 are satisfactorily finished. It will further be appreciated that while the paths 308 and 309 are illustrated as being linear, certain processes can utilize paths that are curved or utilize an arced direction.

According to an alternative embodiment, the reciprocating pathway can be conducted such that one surface of the slot is finished before another surface is finished. For example, the bonded abrasive tool 301 can be moved along a first surface 321 for multiple, sequential passes (i.e., back and forth along path 308) until the first surface 321 is finished with a suitable complex shape. After finishing the first surface 321, the bonded abrasive tool can be shifted laterally along the axis 375 to contact the second surface 323 of the slot 16 opposite the first surface 323. The bonded abrasive tool 301 can then again be moved along the thickness of the slot 16 (i.e., back and forth along the path 309) along the second surface 323 for multiple, sequential passes until the second surface 323 is finished.

In accordance with one embodiment, the finishing process may remove a particular amount of material from the surface of the slot on each pass. For example, during finishing, the bonded abrasive tool 301 may remove material from the surface 321 to a depth of not greater than 100 microns for each pass of the bonded abrasive tool 301 through the slot 16. In other embodiments, the finishing operation may be conducted such that the material is removed to a depth of not greater than about 75 microns, such as not greater than about 65 microns, such as not greater than about 50 microns, or even less for each pass of the bonded abrasive tool 301 through the slot 16. In particular instances, each pass of the bonded abrasive tool 301 may remove material to a depth within a range between 1 micron and about 100 microns, such as between about 1 micron and about 75 microns, or even between about 10 microns and about 65 microns.

Moreover, during finishing, the feed rate of the bonded abrasive tool, which is a measure of the lateral movement of the bonded abrasive tool along the axis 375 between sequential passes at the same surface can be at least about 30 ipm [762 mm/min]. In other embodiments, the feed rate can be greater, such as at least about 50 ipm [1270 mm/min], at least about 75 ipm [1905 mm/min], at least about 100 ipm [2540 mm/min], or even at least about 125 ipm [3175 mm/min]. Certain finishing processes utilize a feed rate within a range between about 30 ipm [762 mm/min] and about 300 ipm [7620 mm/min], such as between about 50 ipm [1270 mm/min] and about 250 ipm [6350 mm/min], or even within a range between about 50 ipm [1270 mm/min] and about 200 ipm [5080 mm/min].

The finishing operation to form the re-entrant shape in the workpiece may be conducted at specific material removal rates. For example, the material removal rate during the finishing operation can be at least about 0.01 inches$^3$/min/inch [0.11 mm$^3$/sec/mm]. In other instances, the finishing process can be conducted at a material removal rate of at least about 0.05 inches$^3$/min/inch [0.54 mm$^3$/sec/mm], such as at least about 0.08 inches$^3$/min/inch [0.86 mm$^3$/sec/mm], at least about 0.1 inches$^3$/min/inch [1.1 mm$^3$/sec/mm], at least about 0.3 inches$^3$/min/inch [3.2 mm$^3$/sec/mm], at least about 1 inch$^3$/min/inch [11 mm$^3$/sec/mm], at least about 1.5 inches$^3$/min/inch [16 mm$^3$/sec/mm], or even at least about 2 inches$^3$/min/inch [22 mm$^3$/sec/mm]

For certain finishing operations, the material removal rate can be not greater than about 1.5 inches$^3$/min/inch [16 mm$^3$/sec/mm]. Still, certain finishing processes may have a material removal rate of not greater than about 1 inch$^3$/min/inch [11 mm$^3$/sec/mm], not greater than about 0.8 inches$^3$/min/inch [8.6 mm$^3$/sec/mm], or even not greater than about 0.3 inches$^3$/min/inch [3.2 mm$^3$/sec/mm].

In particular instances, the finishing process can be conducted such that the material removal rate can be within a range between about 0.01 inches$^3$/min/inch [0.11 mm$^3$/sec/mm] and about 2 inches$^3$/min/inch [22 mm$^3$/sec/mm], such as between about 0.03 inches$^3$/min/inch [0.32 mm$^3$/sec/mm] and about 1.5 inches$^3$/min/inch [16 mm$^3$/sec/mm].

The finishing operation in accordance with embodiments herein may further be conducted at a specific finishing power. For example, the finishing power used during the finishing operation can be not greater than about 5 Hp [3.75 kW] at a feed rate of the mounted point tool within a range between about 30 ipm [762 mm/min] and about 300 ipm [7620 mm/min]. According to certain other embodiments, during finishing the finishing power can be not greater than about 4 Hp [3.0 kW], such as not greater than about 3.8 Hp [2.83 kW], not greater than about 3.6 Hp [2.68 kW], not greater than about 3.4 Hp [2.54 kW], not greater than about 3.2 Hp [2.39 kW], or even not greater than about 3 Hp [2.25 kW]. Such finishing powers may be used at a feed rate of the within a range between about 30 ipm [762 mm/min] and about 300 ipm [7620 mm/min].

It will also be appreciated that the finishing operation is distinct from other material removal operations in that the surface of the workpiece upon completion of the finishing operation can have particular characteristics. For example, turning to FIG. 3B, a cross-sectional illustration of a portion of a workpiece having a finished reentrant-shaped opening 351 is illustrated in accordance with an embodiment. As illustrated, the workpiece 14 can have a re-entrant shaped opening 351 formed therein and defined by surfaces 326 and 327 which have substantially similar contours to that of the bonded abrasive tool 301. In accordance with an embodiment, the finishing process includes forming a surface 326 having has a surface roughness ($R_a$) of not greater than about 2 microns. In other instances, the surface roughness ($R_a$) may be less, such as not greater than about 1.8 microns, such as not greater than about 1.5 microns. In particular instances, the surface roughness ($R_a$) can be within a range between about 0.1 microns and about 2 microns. The surface roughness of the finished surfaces can be measured using a Profilometer, such as a MarSurf UD 120/LD 120 model Profilometer, commonly available from Mahr-Federal Corporation, and operated using MarSurf XCR software.

Upon completion of the finishing operation, the surfaces 326 and 327 defining the re-entrant shaped opening 351 are essentially free of burn. Burn may be evidence as portions of the surfaces 326 or 327 being discolored or having a residue or after etching having a whitish appearance indicating thermal damage to the surfaces during the finishing operation. Finishing processes conducted according to the embodiments herein are capable of producing final surfaces exhibiting little to no burn.

Finishing operations conducted in accordance with embodiments herein may utilize a coolant provided at the interface of the bonded abrasive tool 301 and surface 321 or 323 of the slot 16. The coolant may be provided in a coherent jet as described in U.S. Pat. No. 6,669,118. In other embodiments, the coolant may be provided by flooding the interface area. The bonded abrasive bodies of the embodiments herein may facilitate use of a water-soluble coolant, which may be preferable for environmental reasons over certain other coolants (e.g. non water-soluble coolants). Other suitable coolants can include use of semi-synthetic and/or synthetic coolants. Still, it will be appreciated, that for certain operations, oil-based coolants can be used.

Figure 4:
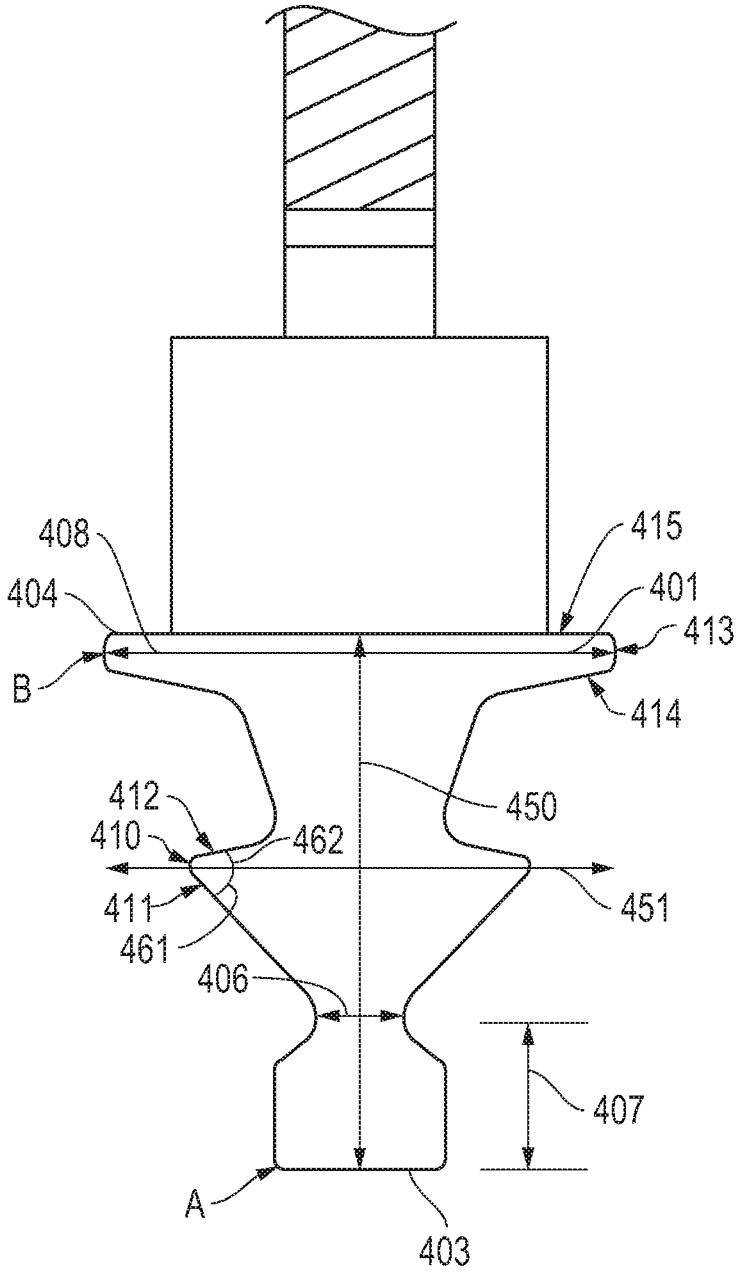
FIG. 4 includes a cross-sectional illustration of a bonded abrasive tool having a complex shape according to an embodiment.

FIG. 4 includes a cross-sectional illustration of an abrasive tool in accordance with an embodiment. In particular, the abrasive tool can be a mounted point abrasive tool which is configured to be rotated at high speeds for finishing of surfaces as described herein. Notable, the abrasive tool includes a bonded abrasive body incorporating abrasive grains dispersed throughout a volume and contained within a volume of bonding material as described herein. More particularly, as illustrated in FIG. 4, the bonded abrasive body can have a complex shape configured to finish complex shapes within a workpiece (e.g. re-entrant shapes).

In accordance with one embodiment, the bonded abrasive body 401 can have a longitudinal axis 450 extending along the length of the body 401 (i.e., the longest dimension of the body) between an upper surface 404 and a lower surface 403. Additionally, a lateral axis 451 can extend perpendicular to the longitudinal axis 450 and define the width of the body 401. In accordance with one embodiment, the complex shape of the bonded abrasive body 401 can be defined by a first radial flange 410 extending from the bonded abrasive body at a first axial position. For example, the first radial flange 410 can extend laterally along the lateral axis 451 and circumferentially around the body 401. The flange 410 can have a first surface 411 that extends radially from the body 401 at a first angle relative to the lateral axis 451. As illustrated, the intersection of the first surface 411 and the lateral axis 451 can define an acute angle 461. Likewise, the flange 410 can be further defined by a second surface 412 extending radially from the bonded abrasive body 410. The second surface 412 can be adjacent to, and even abutting, the first surface 411. The surface 412 can define an acute angle 462 between the lateral axis 451 and the surface 412.

Additionally, the bonded abrasive body 401 may be formed such that it includes a second radial flange 413, which may be distinct from the first radial flange 410. In fact, as illustrated in FIG. 4, the radial flange 413 can be spaced apart from the radial flange 410 along the longitudinal axis 450 at a second axial position, distinct from the axial position of the radial flange 410. In accordance with an embodiment, the radial flange 413 can be defined by surfaces 414 and 415 that can extend radially and circumferentially from the bonded abrasive body to define the flange 413.

In some instances, the cross-sectional shape of the bonded abrasive body 401 may be described as a single-flanged shape, double-flanged shape, triple-flanged shape, and the like. Such shapes can incorporate one or more radial flanges extending from the body to define a re-entrant shape. In other instances, it may be described as a re-entrant-shaped body such that is has dimensions suitable for finishing and forming of a re-entrant shape into a workpiece.

In accordance with one embodiment, the complex shape of the bonded abrasive body 401 may be described by a form depth (FD). The form depth can be described by the equation [(R−Rs)/Rl], wherein Rs is a smallest radius (Rs) (i.e., half of the dimension 406) of the bonded abrasive body 401 at a point along the longitudinal axis 450 and Rl is a largest radius (Rl) (i.e., half of the dimension 408) of the bonded abrasive body 401 at a point along the longitudinal axis 450.

In one embodiment, the bonded abrasive body 401 has a form depth (FD) of at least about 0.3. In other embodiments, the bonded abrasive body 401 can have a form depth (FD) of at least about 0.4, at least about 0.5, at least about 0.6, at least about 0.7, or greater. Certain embodiments may utilize a bonded abrasive body 401 having a form depth (FD) within a range between about 0.3 and about 0.95, such as between about 0.4 and about 0.9, such as between about 0.5 and about 0.9.

The bonded abrasive body 401 may also be described by a form ratio (FR) described by the equation [Fl/Fw]. The dimension Fl is a form length measured as a dimension of the peripheral profile surface along a direction of the longitudinal axis 450 of the bonded abrasive body 401. In particular, the form length can describe the profile length of the bonded abrasive body 401 between points A and B illustrated on FIG. 4, defining the portion of the profile actively engaged in the material removal finishing process. The dimension Fw is a form width, which actually defines the length of the bonded abrasive body between the top surface 404 and the bottom surface 403 along a straight line of the longitudinal axis 450.

In accordance with one embodiment, the bonded abrasive body 401 can have a form ratio [Fl/Fw] of at least about 1.1. In other instances, the bonded abrasive body 401 can have a form ratio of at least about 1.2, such as at least about 1.3, at least about 1.4, at least about 1.5, or even at least about 1.7. Particular embodiments may utilize a bonded abrasive body having a form ratio within a range between about 1.1 and about 3.0, such as between about 1.2 and about 2.8, such as between about 1.2 and about 2.5, such as between about 1.3 and about 2.2, or even between about 1.3 and about 2.0.

Certain dimensional aspects of the bonded abrasive body 401 may further be described by an overhang ratio. The overhang ratio of the bonded abrasive body 401 can be described by the equation [OL/Dm], wherein Dm is a minimum diameter 406 at a point along the longitudinal axis 450 of the bonded abrasive body and OL is the length 407 between the bottom surface 403 of the bonded abrasive body 401 and the point along the longitudinal axis of the bonded abrasive body defining the minimum diameter 406.

According to certain embodiments, the bonded abrasive body 401 can have an overhang ratio (OR) of at least about 1.3. In still other instances, the bonded abrasive body 401 may be formed such that it has an overhang ratio of at least about 1.4, such as at least about 1.5, or even at least about 1.6. The overhang ratio for bonded abrasive body 401 can be within a range between about 1.3 and about 2.5, such as between about 1.3 and about 2.2.

In addition to the characteristics described herein, the bonded abrasive tools can be dressed in-situ with the finishing process. Dressing is understood in the art as a method of sharpening and reshaping of a bonded abrasive body, and is typically an operation conducted on bonded abrasive articles and not an operation suitable for use with other abrasive articles, including for example, single-layered abrasive tools (e.g. electroplated abrasive bodies).

Figure 5:
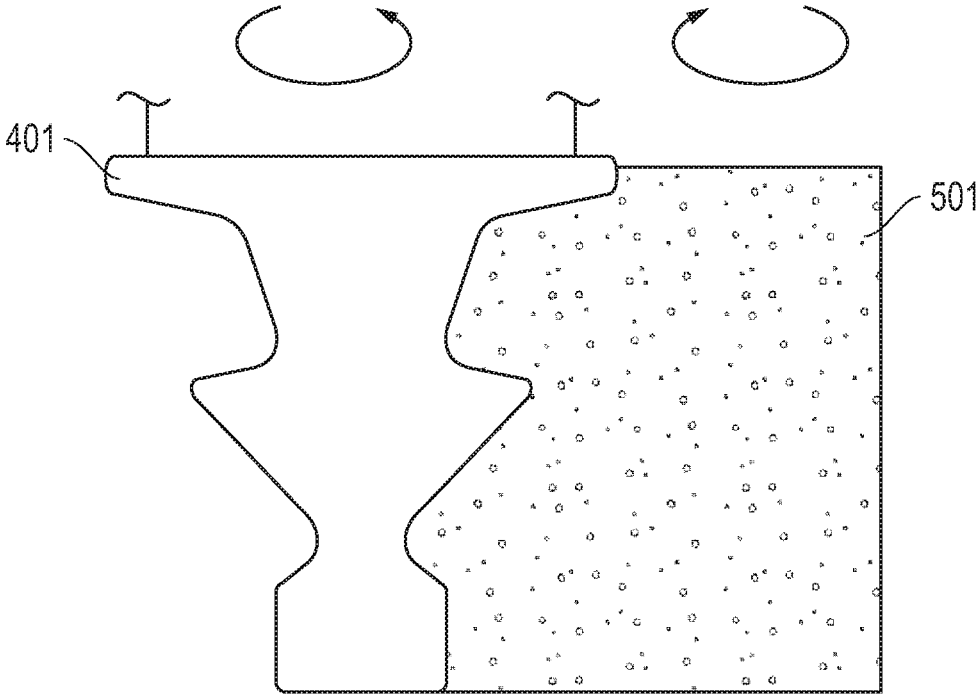
FIG. 5 includes an illustration of a dressing operation on a bonded abrasive tool having a complex shape according to an embodiment.

FIG. 5 includes a cross-sectional illustration of a dressing operation in accordance with an embodiment. In particular, FIG. 5 includes a cross-sectional view of a portion of a bonded abrasive tool 400 including a bonded abrasive body having abrasive grains contained within a matrix of bond material. The bonded abrasive tool according to embodiments herein can be dressed during finishing operations to maintain the contour of the bonded abrasive body, which facilitates improved accuracy of the finishing operation and improved tool life over other conventional mounted point abrasive tools.

During a dressing operation, a dressing material 501, which may include a significantly sharp material, can be placed in contact with the profile edge of the bonded abrasive body 401. The bonded abrasive body 401 may be rotated relative to the dressing material 501 to sharpen and recontour the profile edge of the bonded abrasive body. Alternatively, during dressing the dressing material 501 may be rotated relative to the bonded abrasive body 401. Or in another alternative embodiment, the bonded abrasive body 401 and dressing material 501 can be rotated at the same time, and may be rotated in the same direction or in opposite directions depending upon the type of dressing.

In particular, FIG. 5 illustrates a plunge dressing operation, wherein the dressing material 501 is placed in full contact with the form length of the abrasive body 401. Plunge dressing may offer a significant advantage over other operations as a mechanism to keep the bonded abrasive body 401 having a particular contour suitable for finishing of the surfaces of the workpiece to a complex shape and tight dimensional tolerances. Notably, to conduct a plunge dressing operation, the surface of the dressing material 501 has significantly the same complex contour as the form length of the abrasive body 401 for proper recontouring of the abrasive body 401. That is, the dressing material 501 can be shaped to have a complementary complex shape, such that the dressing material 501 can engage the bonded abrasive body 401 along the full periphery of the form length during dressing. The ability to dress the bonded abrasive body 401 during the finishing operation can facilitate longer tool life and improved consistency of the finish surfaces including dimensions and surface geometries (e.g. $R_a$).

While FIG. 5 illustrates a plunge dressing operation, other dressing operations, including for example, a traverse dressing operation, can be utilized with the bonded abrasive articles of the present embodiments. Traverse dressing can include placing a dressing material in contact with the bonded abrasive, particularly in contact with a portion of the profile of the bonded abrasive body. Notably, traverse dressing differs from plunge dressing in that only a portion of the form length is dressed at any time, since the dressing material is not necessarily given a complex shape to complement the complex shape of the bonded abrasive body, as is the case in plunge dressing. Rather, traverse dressing operations utilize a dressing material that is moved, or traversed, along the complex shape of the form length of the bonded abrasive body until the full form length has been dressed. Traverse dressing may be completed in situ with finishing operations.

EXAMPLES

A workpiece of Inconel 718 having dimensions of 2.85×2.00×1.50 inches was placed in a modified Cinternal ID/OD two-axis CNC grinder available from Heald Grinders.

A finishing operation was conducted on the workpiece using a vitrified CBN mounted point tool (B120-2-B5-VCF10) from Saint-Gobain Corporation having a complex shape as illustrated in FIG. 4. The bonded abrasive body had a form depth (FD) of 0.8, a form ratio (FR) of 1.5, and an overhang ratio of 1.57. The tool had a form width of approximately 4.1 cm, an overhang length (OL) of 1.19 cm, a minimum diameter of 0.762 cm, and a maximum diameter of 3.76 cm.

The finishing process was conducted to simulate finishing of one 2 inch thick rotor with 60 slots to completion (equivalent to removing 1.2 inches of material from a 2 inch workpiece). During finishing, the depth of cut per pass was 0.0005", such that the total depth of cut was a 0.010 inch on each side of a slot at a wheel speed of 40,000 rpm. Notably, the wheel speed of 40,000 rpm produced a range of surface speeds on the bonded abrasive tool ranging from a maximum at the largest diameter of 16,755 sfpm to 3,140 sfpm at the smallest diameter. Two finishing operations were conducted at work speeds of 50 ipm and 100 ipm, and for each of the work speeds, two separate workpieces were used. For each of the tests, 1.2 inches of material was removed from the workpieces without dressing.

On the first test workpiece, 40 passes or 0.020" depth of material was removed from an end of the workpiece (equivalent to completing one slot). On the second workpiece, 0.400 inches of material was removed from each end. Finally, the first workpiece was again used, and 0.400 inches of material was removed from a second end. After finishing, the workpieces were sent for analysis of wear to the finished surfaces. Based on the analysis, there was limited evidence of burn (i.e., white layer of material on the surfaces) and evidence that the finished surfaces were within commercial specifications.

During finishing, an oil coolant (Master Chemical OM-300) was provided at the interface of the bonded abrasive tool and the surface of the workpiece using a nozzle designed to target multiple jets across the form at 100 psi with a flow rate of approximately 29.2 gpm.

The bonded abrasive body was dressed under the conditions set forth in Table 1 below. The bonded abrasive body was dressed twice; once at the start of the 100 ipm test and again at the start of the 50 ipm test.

TABLE 1

| Dressing Conditions |
|---|
| Mounted Point Speed (rpm): 40,000 |
| Dress Roll Speed (rpm): 3,650 |
| Feed per Mounted point revolution (μin): 3.75 |
| Feed rate (ipm): 0.15 |
| Speed Ratio Range (max/min): 1.83-.27 |

Figure 6A:
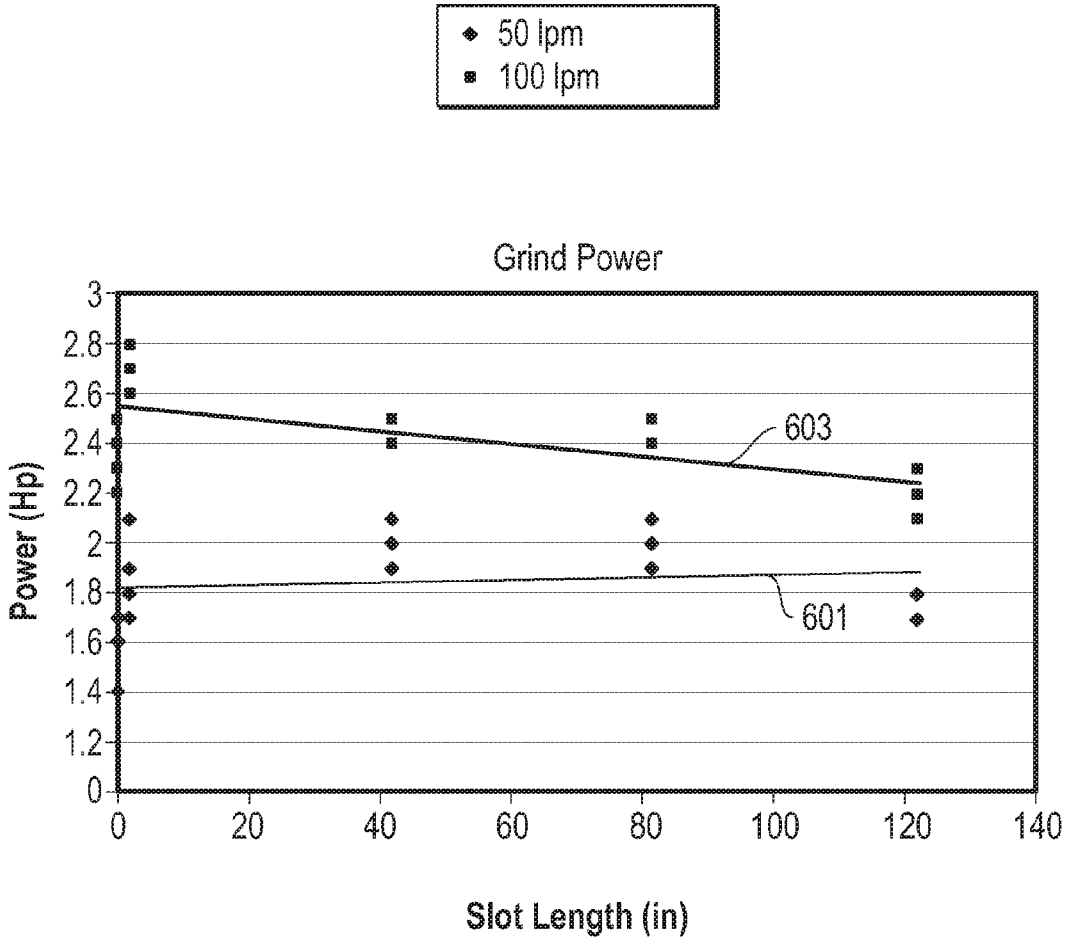
FIGS. 6A-6B include plots of performance parameters measured during a finishing operation conducted according to an embodiment.
Figure 6B:
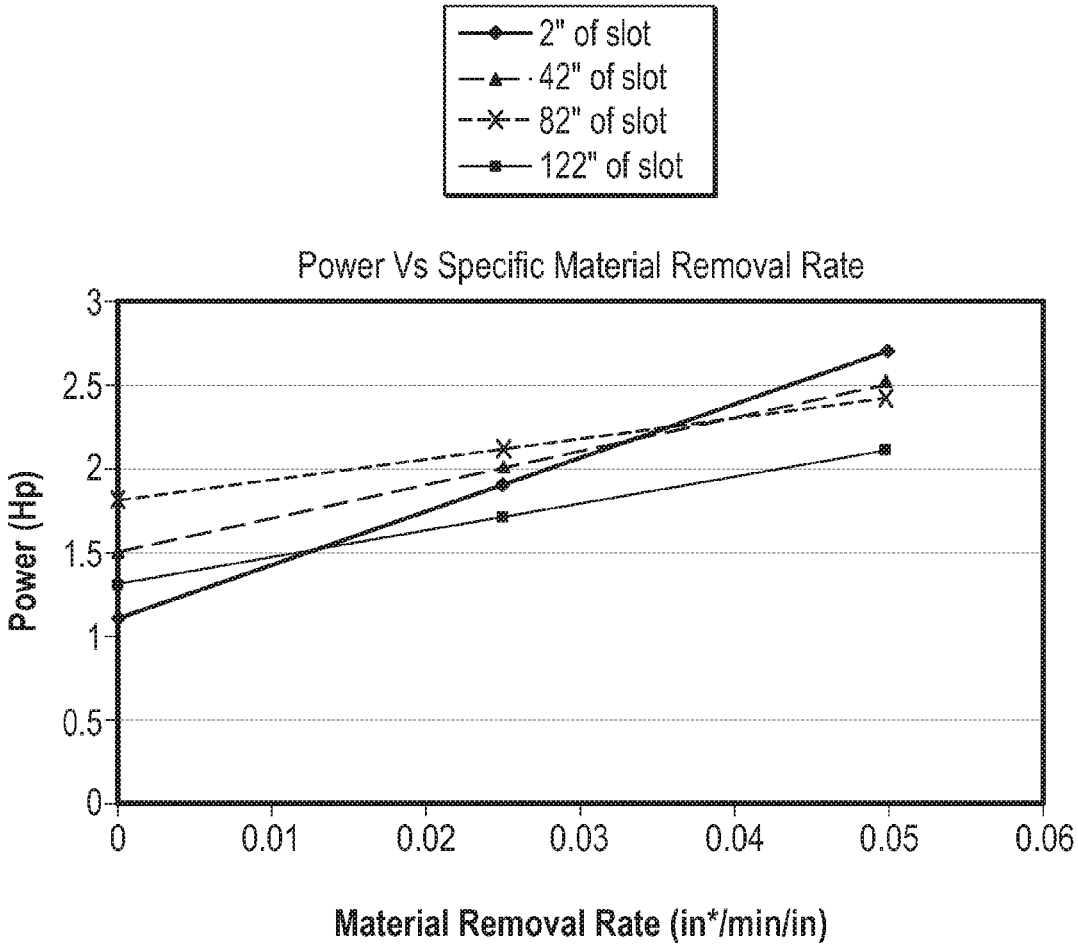

Certain performance parameters are illustrated in the plots of FIGS. 6A and 6B. FIG. 6A includes a plot of finishing power (Hp) versus slot length (i.e., the number of inches of slot length finished) for the finishing operations. In particular, plot 601 represents power versus slot length for the finishing operation conducted at 50 ipm and plot 603 represents power versus slot length for the finishing operation 100 ipm. As noted, the finishing power did not exceed 2.2 Hp for the material removal process at 50 ipm, and the finishing power did not exceed 2.8 Hp for material removal at 100 ipm. The results demonstrate significantly limited finishing power necessary for many slots.

FIG. 6B includes plots of finishing power (Hp) versus specific material removal rate corresponding to 50 and 100 ipm for various lengths of completed slot. As demonstrated by FIG. 6B, the finishing power was less than 2.8 Hp for specific material removal rates of up to 0.5 $in^3$/min/in. The results demonstrate significantly limited power necessary for finishing of the surface with commercially acceptable material removal rates.

The abrasive tool and method of finishing workpieces using the abrasive tools of embodiments herein represent a departure from the state of the art. In particular, state of the art mechanisms for finishing such workpieces and materials, particularly to form re-entrant shapes in materials to tight dimensional tolerances have not utilized the tools or mechanisms described herein. In particular, the abrasive tools of embodiments herein utilize a combination of features including, for example, abrasive grains disbursed volumetrically in a matrix of bonding material, complex shapes described by form depth, overhang ratio, and form ratio. Moreover, the bonded abrasive tools of embodiments herein are utilized in a particular manner to facilitate finishing operations having characteristics which have not been utilized before. In particular, the bonded abrasive tools are capable of finishing workpieces to complex re-entrant shapes under particular conditions including locational speeds of the tool, feed rates, material removal rates, finishing power, and the like. Moreover, utilization of the abrasive tools herein in combination with the methods described facilitates a new process for finishing of workpieces to tight dimensional tolerances while maintaining the shape of the tool thereby facilitating accuracy of the shape and surface formed and extending the usable life of the tool thereby improving the efficiency of the operation.

What is claimed is:

1. An abrasive tool comprising:

a bonded abrasive body having abrasive grains dispersed throughout a three-dimensional volume of a bonding material, wherein the bonded abrasive body comprises a complex shape having a form depth (FD) of at least about 0.3, wherein the complex shape comprises a first radial flange extending from the bonded abrasive body at a first axial position and wherein the bonded abrasive body comprises an overhang ratio (OR) of at least about 1.3.

2. The abrasive tool of claim 1, wherein the first radial flange comprises a first surface extending radially from the bonded abrasive body at a first angle relative to a lateral axis of the bonded abrasive body.

3. The abrasive tool of claim 2, wherein the first angle is an acute angle.

4. The abrasive tool of claim 1, wherein the complex shape comprises a second radial flange extending from the bonded abrasive body at a second axial position, wherein the first radial flange and second radial flange are spaced apart from each other along a longitudinal axis of the bonded abrasive body.

5. The abrasive tool of claim 1, wherein the bonded abrasive body comprises a form ratio (FR) of at least about 1.1.

6. The abrasive tool of claim 5, wherein the bonded abrasive body comprises a form ratio (FR) within a range between about 1.1 and about 3.0.

7. The abrasive tool of claim 1, wherein the complex shape comprises a radial channel extending between first and second radial flanges extending axially from the bonded abrasive body.

8. The abrasive tool of claim 1, wherein the bonding material comprises a vitreous bonding material and wherein the vitreous bonding material comprises between about 2 vol % and about 60 vol % of the total volume of the bonded abrasive body.

9. The abrasive tool of claim 1, wherein the form depth (FD) is within a range between about 0.3 and about 0.95.

10. The abrasive tool of claim 1, wherein the bonded abrasive body comprises an overhang ratio (OR) within a range between about 1.3 and about 2.2.

11. The abrasive tool of claim 1, wherein the abrasive grains have an average grit size of between about 20 microns and 100 microns.

12. The abrasive tool of claim 1, wherein the abrasive grains comprise between about 6 vol % and about 54 vol % of the total volume of the bonded abrasive body.

13. The abrasive tool of claim 1, wherein the body comprises an amount of porosity within a range between about 2 vol % and about 30 vol % of the total volume of the bonded abrasive body.

14. A method of operating an abrasive tool comprising:

finishing a re-entrant shape opening in a workpiece using a mounted point abrasive tool comprising a bonded abrasive body comprising abrasive grains dispersed throughout a three-dimensional volume of a bonding material, wherein the bonded abrasive body comprises a complex shape having a form depth (FD) of at least about 0.3, wherein the complex shape comprises a first radial flange extending from the bonded abrasive body at a first axial position and wherein the bonded abrasive body comprises an overhang ratio (OR) of at least about 1.3; and plunge dressing the mounted point abrasive tool along a form length of the bonded abrasive body.

15. The method of claim 14, wherein dressing comprises rotating a dressing body at different velocities at different positions along a form length of the bonded abrasive body.

16. The method of claim 14, wherein finishing comprises forming a finished surface defining the re-entrant shape opening in the workpiece having an average surface roughness ($R_a$) of not greater than about 2 microns.

17. The method of claim 14, wherein during finishing a water-soluble coolant material is provided at an interface of the mounted point abrasive tool and a surface of the workpiece defining the re-entrant shaped opening.

18. The method of claim 14, wherein during finishing, the material removal rate is within a range between about 0.03 inches$^3$/min/inch [0.32 mm$^3$/sec/mm] and about 1.5 inches$^3$/min/inch [16 mm$^3$/sec/mm].

19. The method of claim 14, wherein during finishing, the finishing power used is not greater than about 3 Hp [2.25 kW] at a feed rate of the mounted point tool within a range between about 30 ipm [762 mm/min] and about 300 ipm [7620 mm/min].

20. The method of claim 14, wherein after finishing, the workpiece is essentially free of burn.

* * * * *